US009028100B2

(12) United States Patent
Li et al.

(10) Patent No.: US 9,028,100 B2
(45) Date of Patent: May 12, 2015

(54) ADJUSTABLE LED LENS AND LAMP WITH THE SAME

(71) Applicant: National Kaohsiung University of Applied Sciences, Kaohsiung (TW)

(72) Inventors: Hsiao-I Li, Zhubei (TW); Yong-Lin Chang, Kaohsiung (TW); Wei-Chen Yen, Kaohsiung (TW); Yung-Ta Tsai, Kaohsiung (TW)

(73) Assignee: National Kaohsiung University of Applied Sciences, Kaohsiung (TW)

( * ) Notice: Subject to any disclaimer, the term of this patent is extended or adjusted under 35 U.S.C. 154(b) by 105 days.

(21) Appl. No.: 13/727,233

(22) Filed: Dec. 26, 2012

(65) Prior Publication Data

US 2013/0170216 A1 Jul. 4, 2013

(30) Foreign Application Priority Data

Dec. 29, 2011 (TW) ..... 100149394 A

(51) Int. Cl.

| | |
|---|---|
| ***F21S 8/00*** | (2006.01) |
| ***F21V 5/04*** | (2006.01) |
| ***F21K 99/00*** | (2010.01) |
| ***F21V 17/02*** | (2006.01) |
| ***F21V 17/06*** | (2006.01) |
| *F21V 14/04* | (2006.01) |
| *F21V 14/06* | (2006.01) |
| *F21Y 101/02* | (2006.01) |
| *F21Y 105/00* | (2006.01) |

(52) U.S. Cl.

CPC ... *F21V 5/04* (2013.01); *F21K 9/58* (2013.01); *F21V 14/04* (2013.01); *F21V 14/06* (2013.01); *F21V 17/02* (2013.01); *F21V 17/06* (2013.01); *F21Y 2101/02* (2013.01); *F21Y 2105/001* (2013.01)

(58) Field of Classification Search

CPC ..... F21K 9/58; F21V 14/06; F21Y 2101/02
USPC ..... 362/277, 319
See application file for complete search history.

(56) References Cited

U.S. PATENT DOCUMENTS

| | | | | |
|---|---|---|---|---|
| 7,222,995 | B1 * | 5/2007 | Bayat et al. | 362/327 |
| 7,871,192 | B2 * | 1/2011 | Chien | 362/641 |
| 7,959,328 | B2 * | 6/2011 | Wanninger | 362/309 |
| 8,047,685 | B2 * | 11/2011 | Wu et al. | 362/277 |
| 8,297,799 | B2 * | 10/2012 | Chou | 362/311.02 |
| 2007/0030572 | A1 * | 2/2007 | Lee et al. | 359/642 |

* cited by examiner

*Primary Examiner* — Stephen F Husar
(74) *Attorney, Agent, or Firm* — C. G. Mersereau; Nikolai & Mersereau, P.A.

(57) ABSTRACT

The adjustable LED lens has a body having a light incident surface and a light-emitting surface respectively mounted on two opposite sides of the body. The light-emitting surface has a concave tapered surface. The adjustable LED lens is mounted on a holder. A distance between the adjustable LED lens and the holder is changeable. An LED is mounted on the holder, wherein a light generated by the LED passes through the light incident surface and the light-emitting surface of the body. The concave tapered surface of the light-emitting surface increases a light distribution angle to increase an illumination range and decrease a glare. The distance between the adjustable LED lens and the LED is changeable to adjust a light shape as desired.

2 Claims, 14 Drawing Sheets

ADJUSTABLE LED LENS AND LAMP WITH THE SAME

BACKGROUND OF THE INVENTION

1. Field of the Invention

The present invention relates to an adjustable LED lens and a lamp with the same, and more particularly to an adjustable LED lens that is able to adjust a light distribution angle and an illumination range, and an adjustable LED lamp having a holder with the same.

2. Description of Related Art

A glowing angle of an LED is narrower than that of a conventional light source, so the LED is suitable for a light source of unidirectional light such as a flashlight and a searchlight. Due to the above-mentioned feature, the LED is not suitable for a light source of a full solid angle light that radially glows.

In order to apply the LED on a wide-angle light, a spherical lampshade is designed. The spherical lampshade is mounted on a holder with the LED and has a concave circular light incident surface and a convex circular light-emitting surface. The concave circular light incident surface and the convex circular light-emitting surface scatter light to increase an angle of a light irradiating out.

The spherical lampshade increases the angle of the light irradiating out, but the light irradiating out still concentrates below the spherical lampshade. Therefore, there is usually not enough luminance for a ceiling, such that an irradiating range is narrow and the glare index increases.

SUMMARY OF THE INVENTION

The main objective of the invention is to provide an adjustable LED lens for a lamp having a wide irradiating angle and a low glare index.

The adjustable LED lens comprises a body having a light incident surface and a light-emitting surface respectively mounted on two opposite sides of the body. The light-emitting surface has a concave tapered surface. The lamp has a holder to receive an LED and the adjustable LED lens. The adjustable LED lens is mounted movably on the holder. The LED is covered by the adjustable LED lens. A light generated by the LED can pass through the light incident surface of the body. The light irradiates out from the light-emitting surface. An irradiating angle of the light is adjusted by the concave tapered surface. As light passes through the lens, a reflection and a refraction of light increase a light distribution angle to increase a illuminance range and decrease a glare index.

A distance between the light incident surface of the adjustable LED lens and the LED of the holder is adjustable to form an appropriate light shape.

DETAILED DESCRIPTION OF THE PREFERRED EMBODIMENTS

Figure 3:
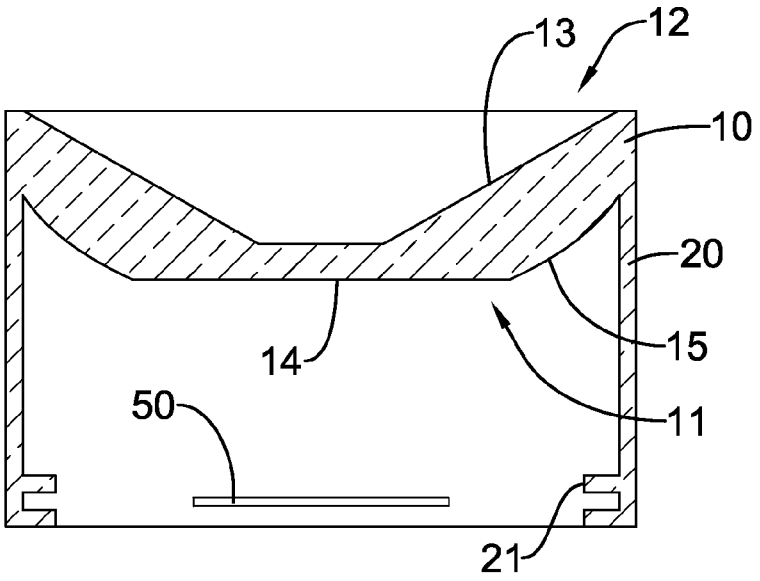
FIG. 3 is an operational side view in partial section of the adjustable LED lens in FIG. 1 with an LED, showing the wide-angle projection.
Figure 10:
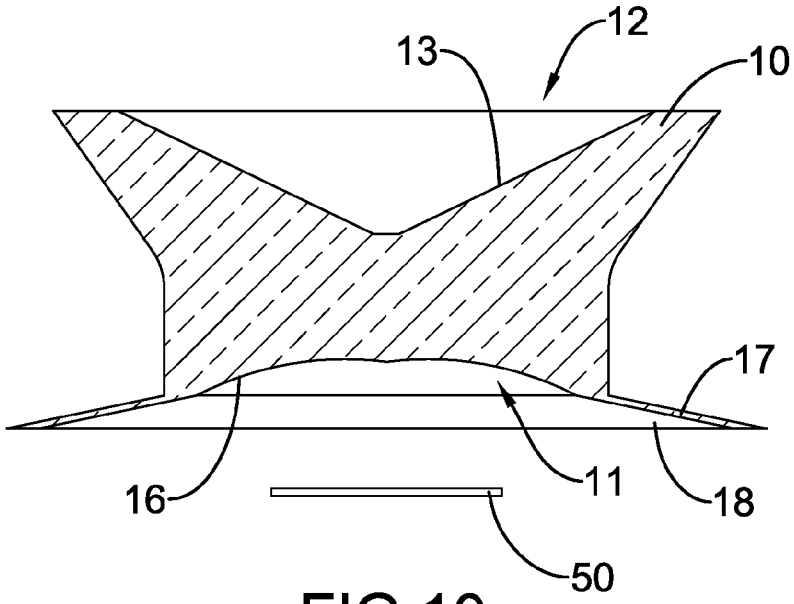
FIG. 10 is an operational side view in partial section of the adjustable LED lens in FIG. 9 with an LED, showing the wide-angle projection.
Figure 18:
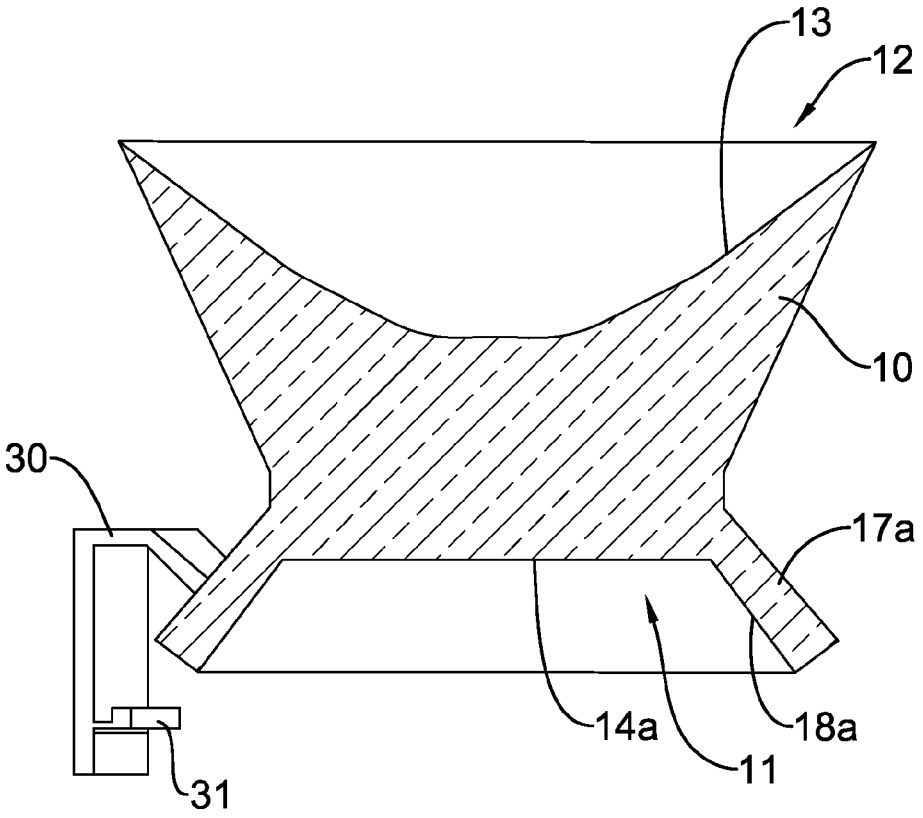
FIG. 18 is a side view in partial section of the adjustable LED lens in FIG. 16.

With reference to FIGS. 3, 10 and 18, an adjustable LED lens in accordance with the present invention comprises a body 10 having a light incident surface 11 and a light-emitting surface 12 respectively formed on two opposite sides of the body 10. The light-emitting surface 12 has a concave tapered surface 13.

Figure 4:
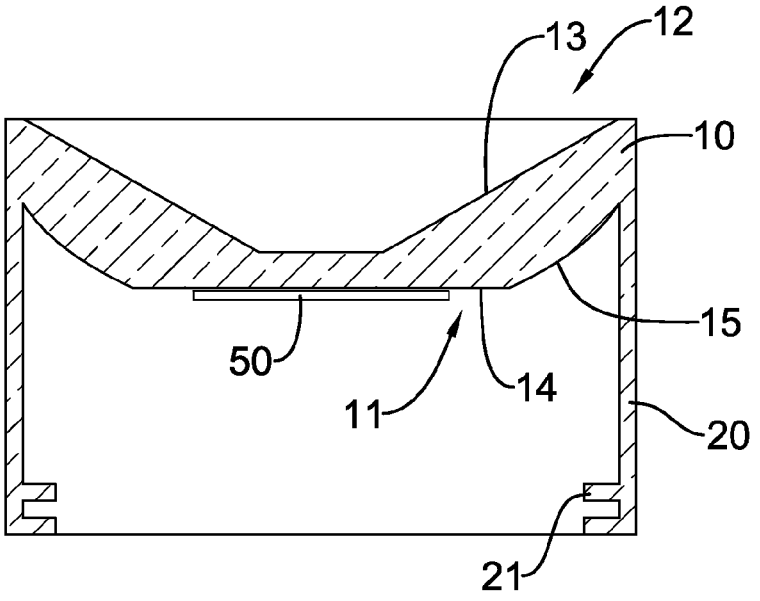
FIG. 4 is an operational side view in partial section of the adjustable LED lens in FIG. 1 with an LED, showing the narrow angle projection.

With reference to FIGS. 3 and 4, the light incident surface 11 has a flat surface 14. A convex cambered surface 15 is formed on a periphery of the flat surface 14. The body 10 has a mounting wall 20 that surrounds the light incident surface 11 and extends out of the light incident surface 11. A mounting part 21 is formed on an inner side of the mounting wall 20.

Figure 1:
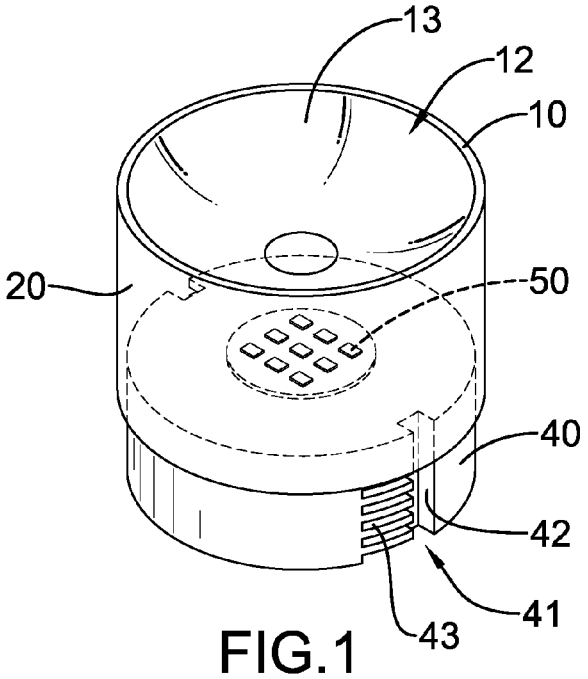
FIG. 1 is a perspective view of a lamp with a first embodiment of an adjustable LED lens in accordance with the present invention.
Figure 2:
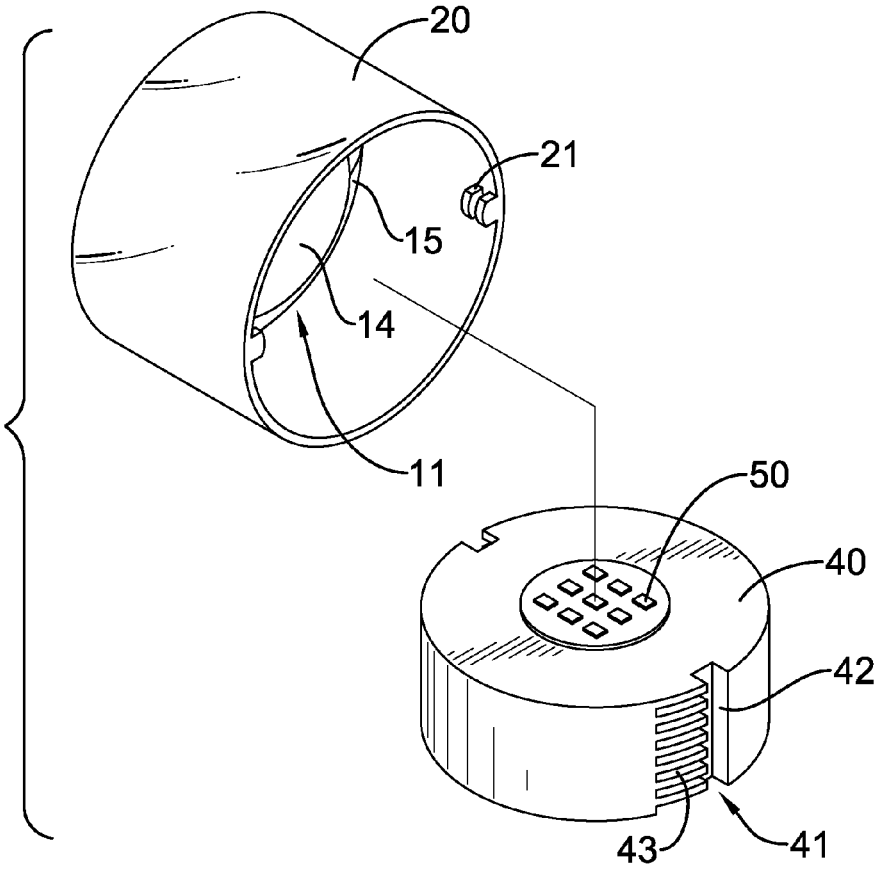
FIG. 2 is an exploded perspective view of the lamp in FIG. 1.

With reference to FIGS. 1 and 2, the adjustable LED lamp has a holder 40. An LED 50 is mounted on the holder 40 and covered by the adjustable LED lens as described. A mounting groove 41 corresponding to the mounting part 21, is formed on an outer side of the holder 40 and has a longitudinal groove 42 and multiple transverse grooves 43. The transverse grooves 43 are connected to the longitudinal groove 42. The mounting part 21 of the adjustable LED lens is put in one of the transverse grooves 43 to adjust a distance between the LED 50 and the light incident surface 11.

Figure 5:
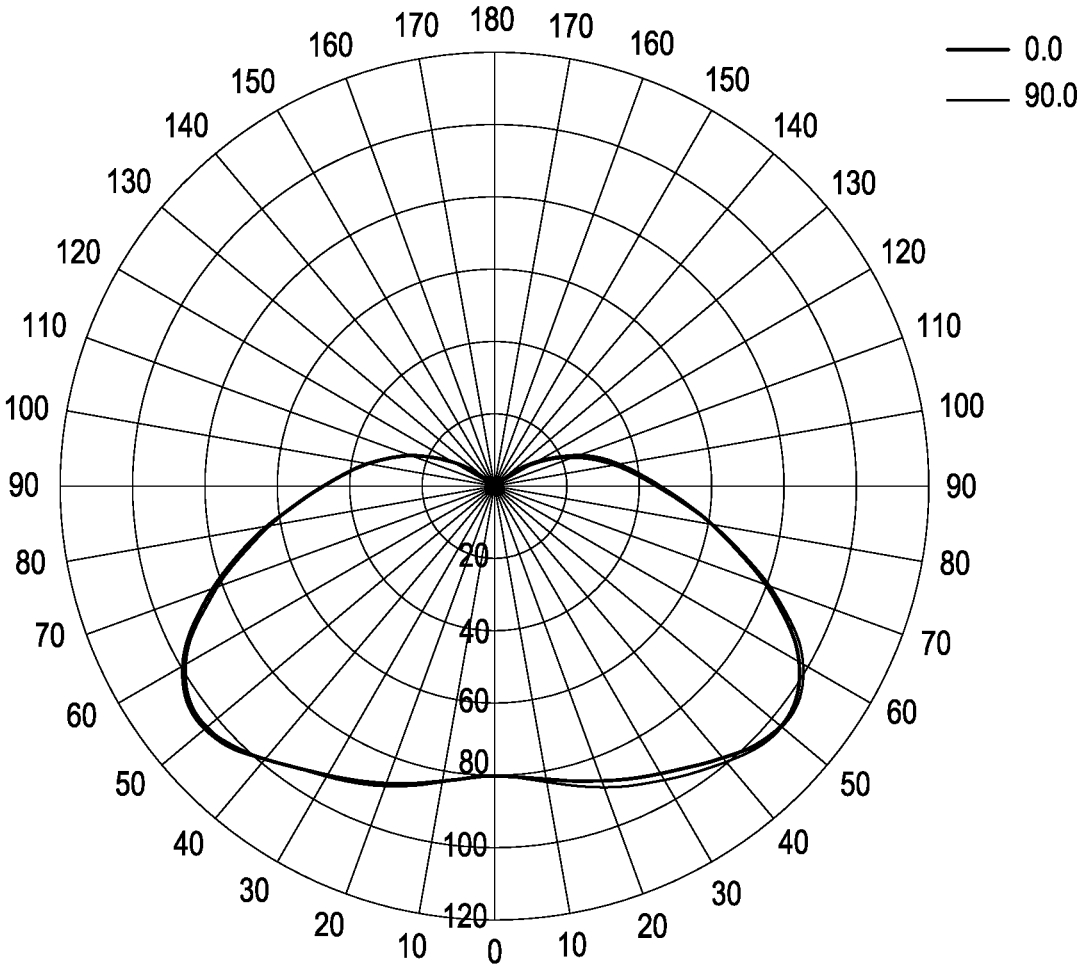
FIG. 5 is a light shape diagram of a wide-angle projection of the lamp in FIG. 1.
Figure 6:
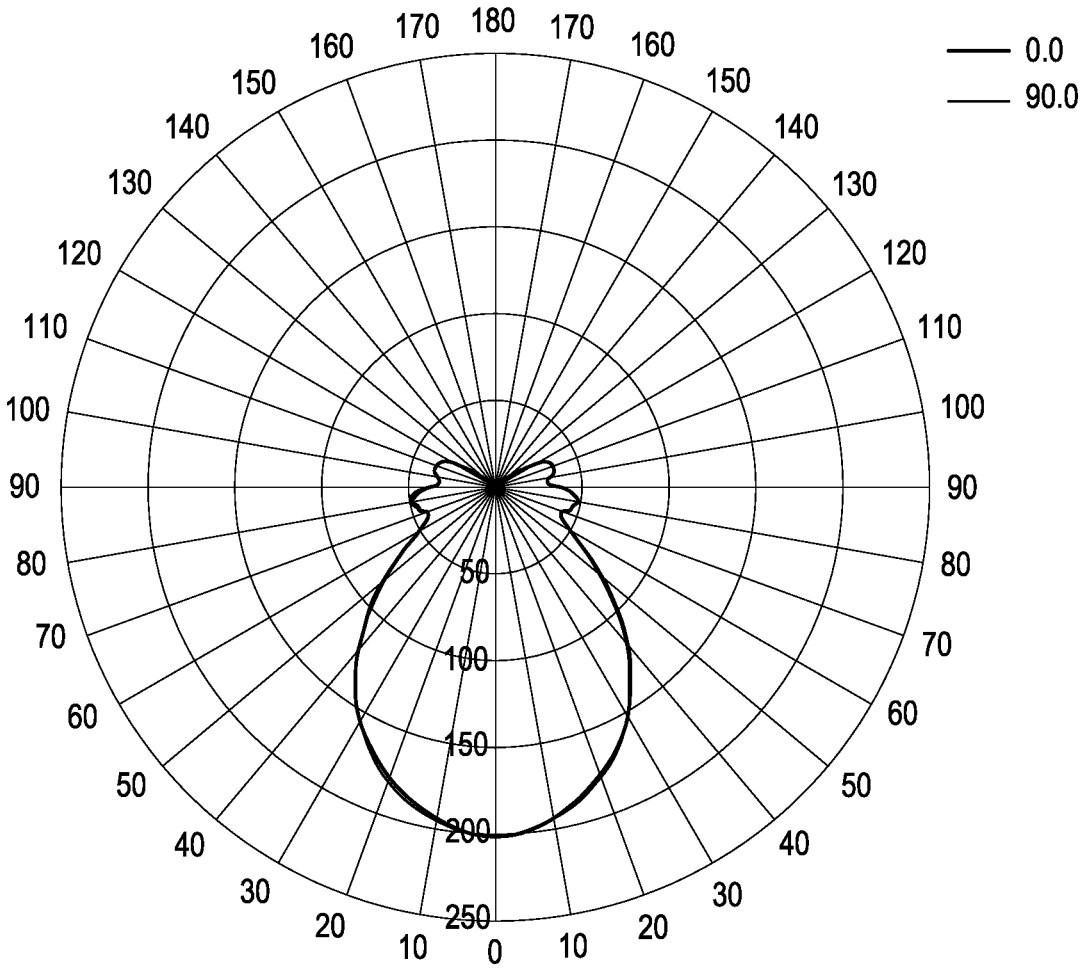
FIG. 6 is a light shape diagram of a narrow angle projection of the lamp in FIG. 1.

With reference to FIGS. 3 and 5, when the distance between the LED 50 and the light incident surface 11 becomes farther, a light distribution angle showed in a light shape diagram becomes bigger. The adjustable LED lamp is at wide-angle projection mode. With reference to FIGS. 4 and 6, when the distance between the LED 50 and the light incident surface 11 becomes shorter, the light distribution angle showed in the light shape diagram becomes smaller. The adjustable LED lamp is at narrow angle projection mode. In addition, the light distribution angles of the adjustable LED lamp are all bigger than that of a conventional ball bulb whether the adjustable LED lamp is at wide-angle projection mode or narrow angle projection mode.

Figure 7:
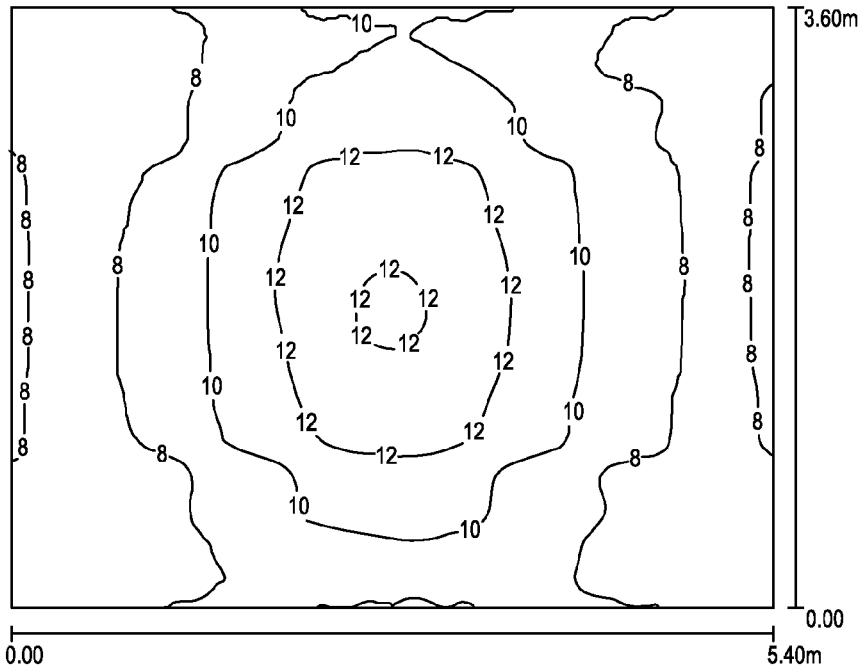
FIG. 7 is an illuminance distribution diagram of a ceiling with a conventional ball bulb.
Figure 8:
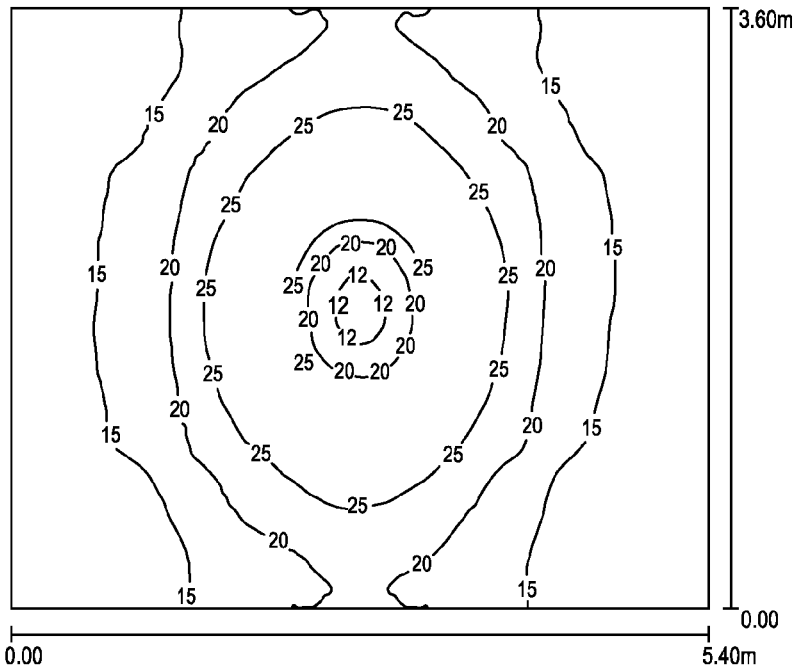
FIG. 8 is an illuminance distribution diagram of a ceiling with the lamp in FIG. 1 at wide-angle projection mode.

With reference to FIGS. 7 and 8, the units are lux and the scales are 1:39. According to the illuminance distribution diagrams of the ceiling, the adjustable LED lens allows more light to irradiate to the ceiling, so the illuminance of the ceiling with the adjustable LED lens is better than that with the conventional ball bulb. A user can adjust the distance between the LED 50 and the light incident surface 11 to choose an appropriate light shape angle range as desired.

Figure 9:
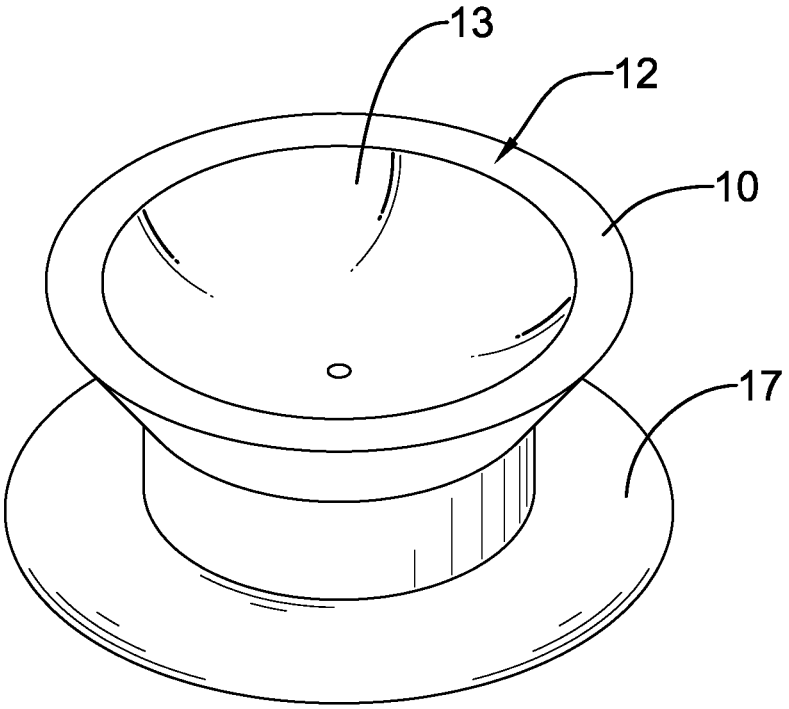
FIG. 9 is a perspective view of a second embodiment of an adjustable LED lens in accordance with the present invention.
Figure 11:
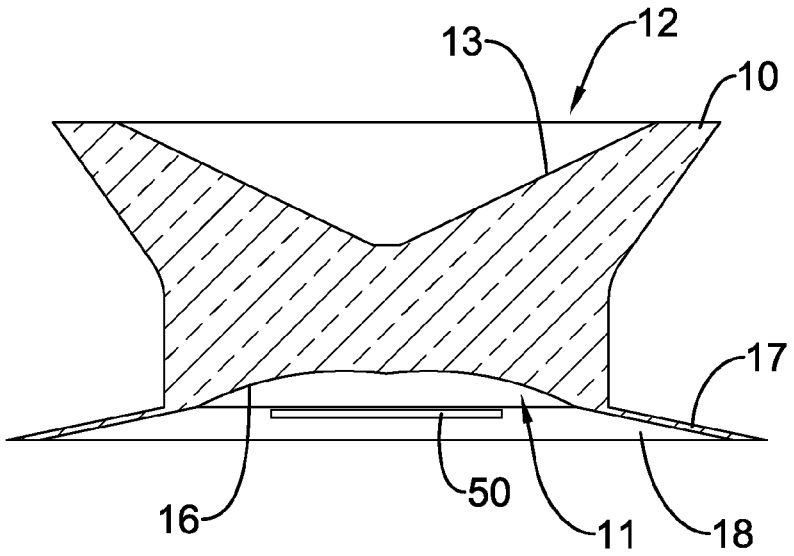
FIG. 11 is an operational side view in partial section of the adjustable LED lens in FIG. 9 with an LED, showing the narrow angle projection.

In another preferred embodiment as shown in FIGS. 9, 10 and 11 the light incident surface 11 has a concave cambered surface 16 and a reflection wing 17. The reflection wing 17 is formed on an outer edge of the body 10 that abuts the light incident surface 11. The reflection wing 17 has a reflection surface 18 that abuts the light incident surface 11. The reflection surface 18 is tapered, wherein the adjustable LED lens is adapted to be mounted on a holder with an LED. A light generated by the LED passes through the light incident surface 11 and the light-emitting surface 12. A light distribution angle is increased by a refraction and a reflection. The light distribution angle of a part of the light can also be increased by the reflection of the reflection surface 18.

Figure 12:
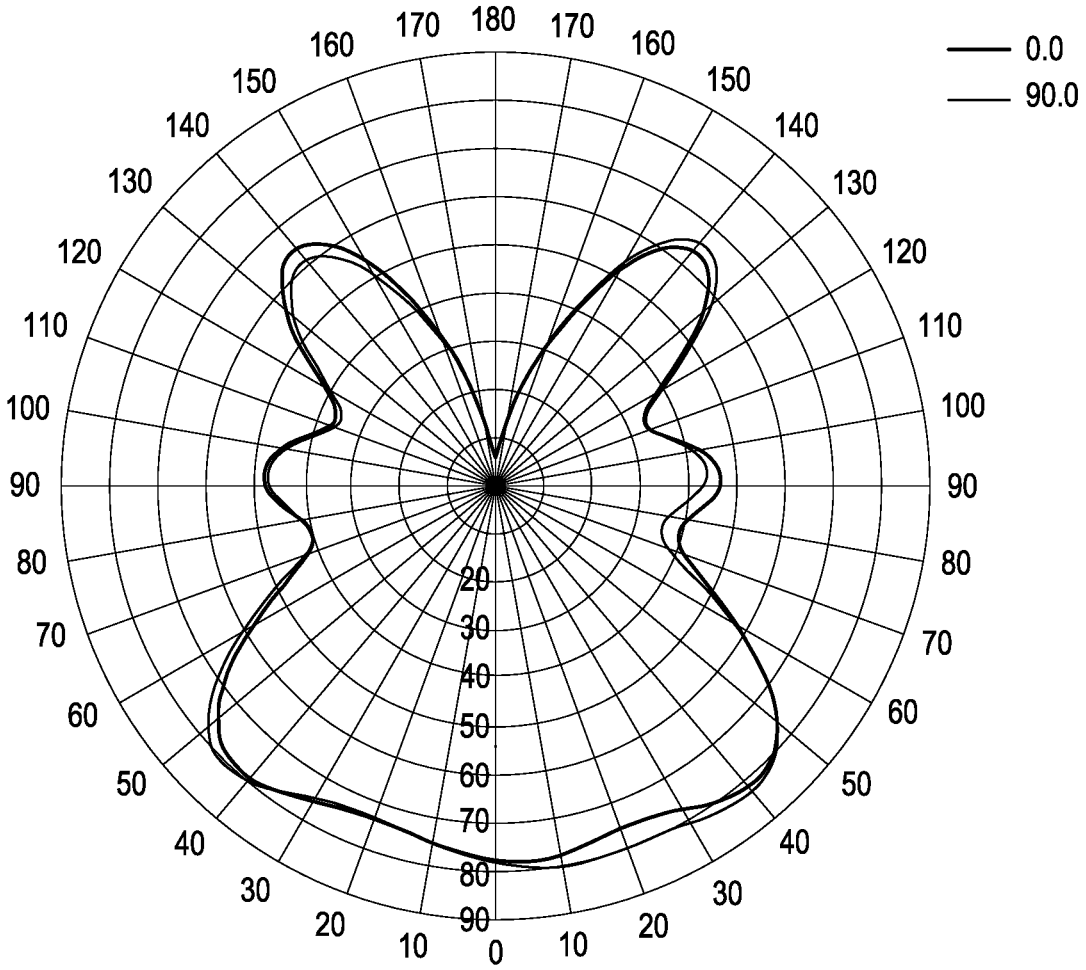
FIG. 12 is a light shape diagram of a wide-angle projection of the lamp with the adjustable LED lens in FIG. 9.
Figure 13:
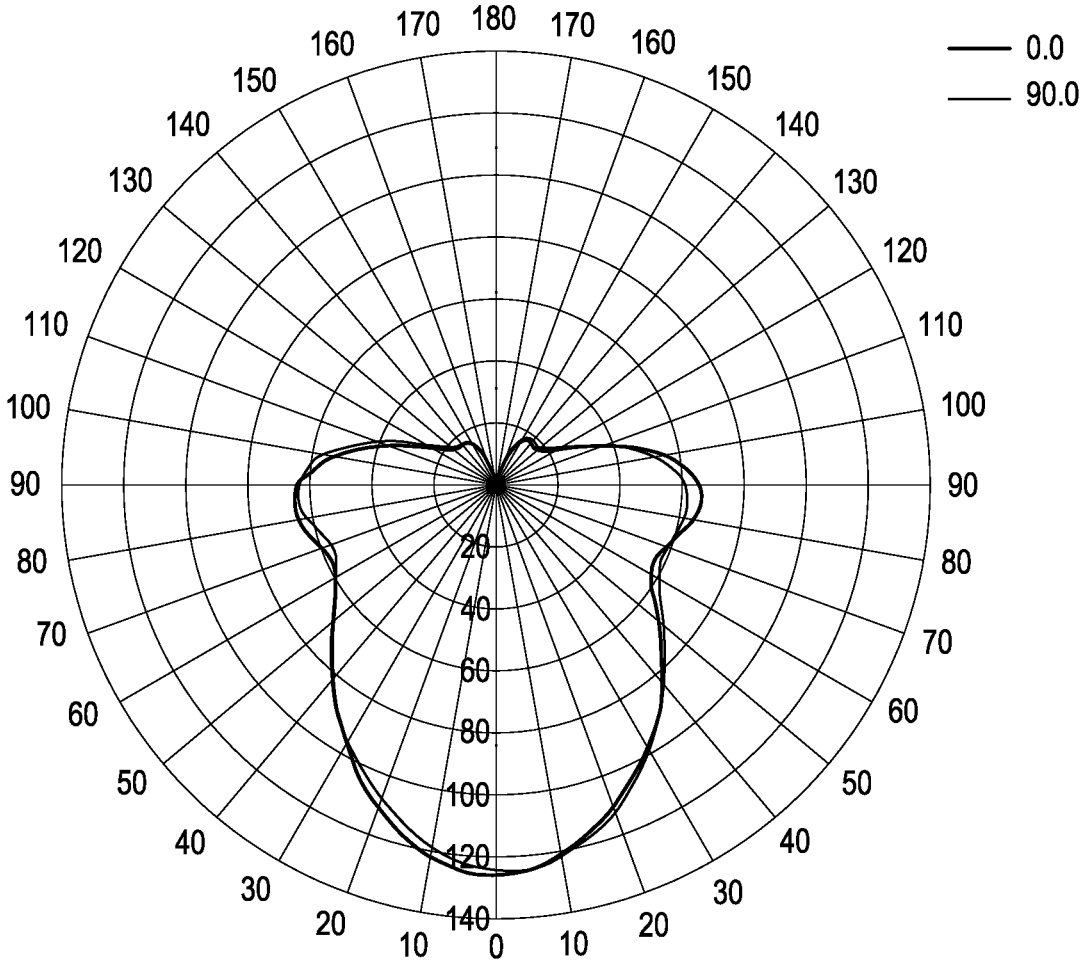
FIG. 13 is a light shape diagram of a narrow angle projection of the lamp with the adjustable LED lens in FIG. 9.

With reference to FIGS. 10 and 11, when the distance between the LED 50 and the light incident surface 11 is farther, the adjustable LED lens is at wide-angle projection mode. When the distance between the LED 50 and the light incident surface 11 is shorter, the adjustable LED lens is at narrow angle projection mode. With reference to FIGS. 12 and 13, a light distribution angle of the adjustable LED lens at wide-angle projection mode can be bigger than that of the conventional ball bulb. A light distribution angle of the adjustable LED lens at narrow angle projection mode can be smaller than that of the conventional ball bulb. The mode of the adjustable LED lens is changeable as desired.

Figure 14:
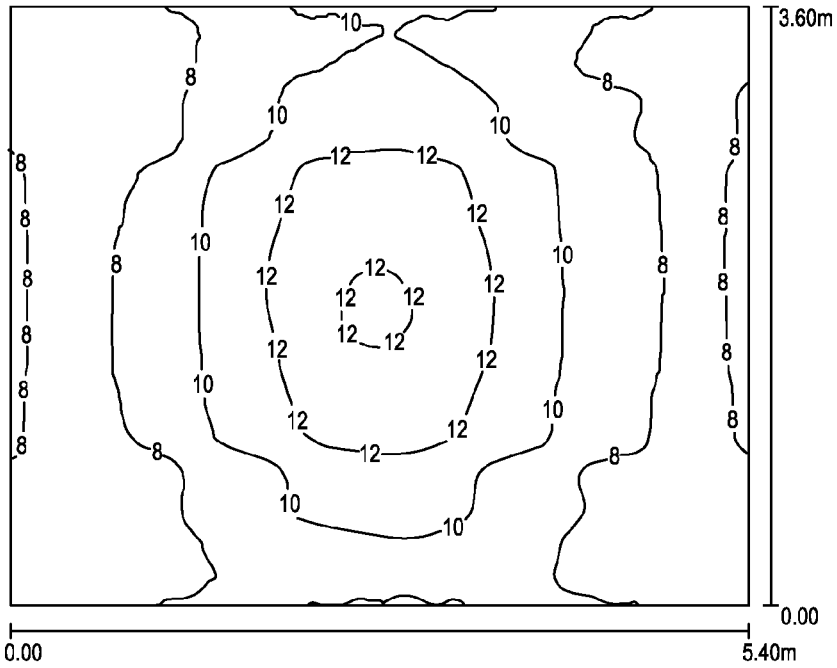
FIG. 14 is an illuminance distribution diagram of a ceiling with a conventional ball bulb.
Figure 15:
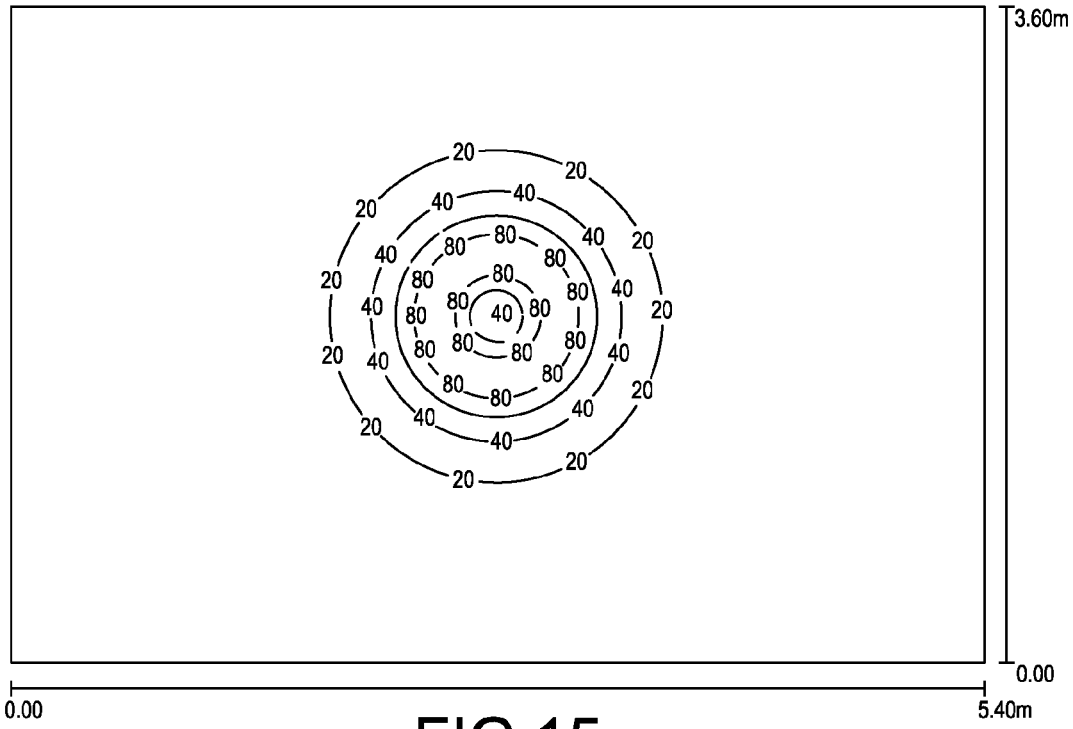
FIG. 15 is an illuminance distribution diagram of a ceiling with the lamp having the adjustable LED lens in FIG. 9 at wide-angle projection mode.

With reference to FIGS. 14 and 15, the units are lux and the scales are 1:39. According to the illuminance distribution diagrams of the ceiling, the adjustable LED lens is better than the conventional ball bulb.

Figure 16:
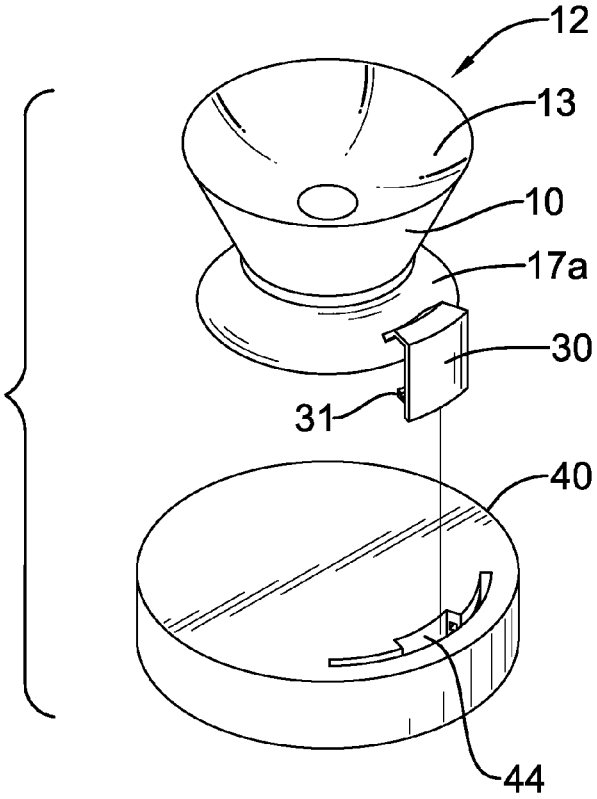
FIG. 16 is an exploded perspective view of a lamp with a third embodiment of an adjustable LED lens in accordance with the present invention.
Figure 17:
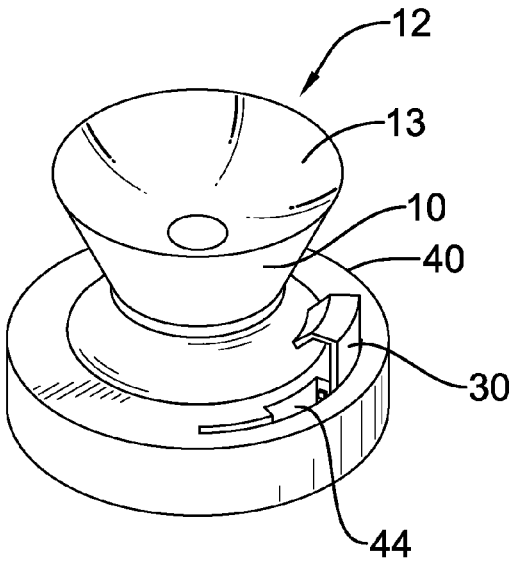
FIG. 17 is a perspective view of the lamp in FIG. 16.

In another preferred embodiment as shown in FIGS. 16, 17 and 18, the light incident surface 11 has a flat surface 14*a* and a reflection wing 17*a* formed on an outer edge of the body 10 that abuts the light incident surface 11. The reflection wing 17*a* has a reflection surface 18*a* that abuts the light incident surface 11. The reflection surface 18*a* is a tapered surface. The lens has at least one mounting stand 30. The mounting stand is mounted on the reflection wing 17*a*. The mounting stand 30 is bent. A fastening part 31 is formed near an end of the mounting stand 30. The adjustable LED lamp has a holder 40. An LED 50 is mounted on the holder 40. The adjustable LED lens is movably mounted on the holder 40 and covers the LED 50. A fastening groove 44 is formed on the holder 40 and corresponds to the fastening part 31. The adjustable LED lens may have a layer coated thereon to increase a reflectivity of the adjustable LED lens. The user can adjust the distance between the LED 50 and the light incident surface 11 to choose an appropriate light shape angle range as desired.

Figure 19:
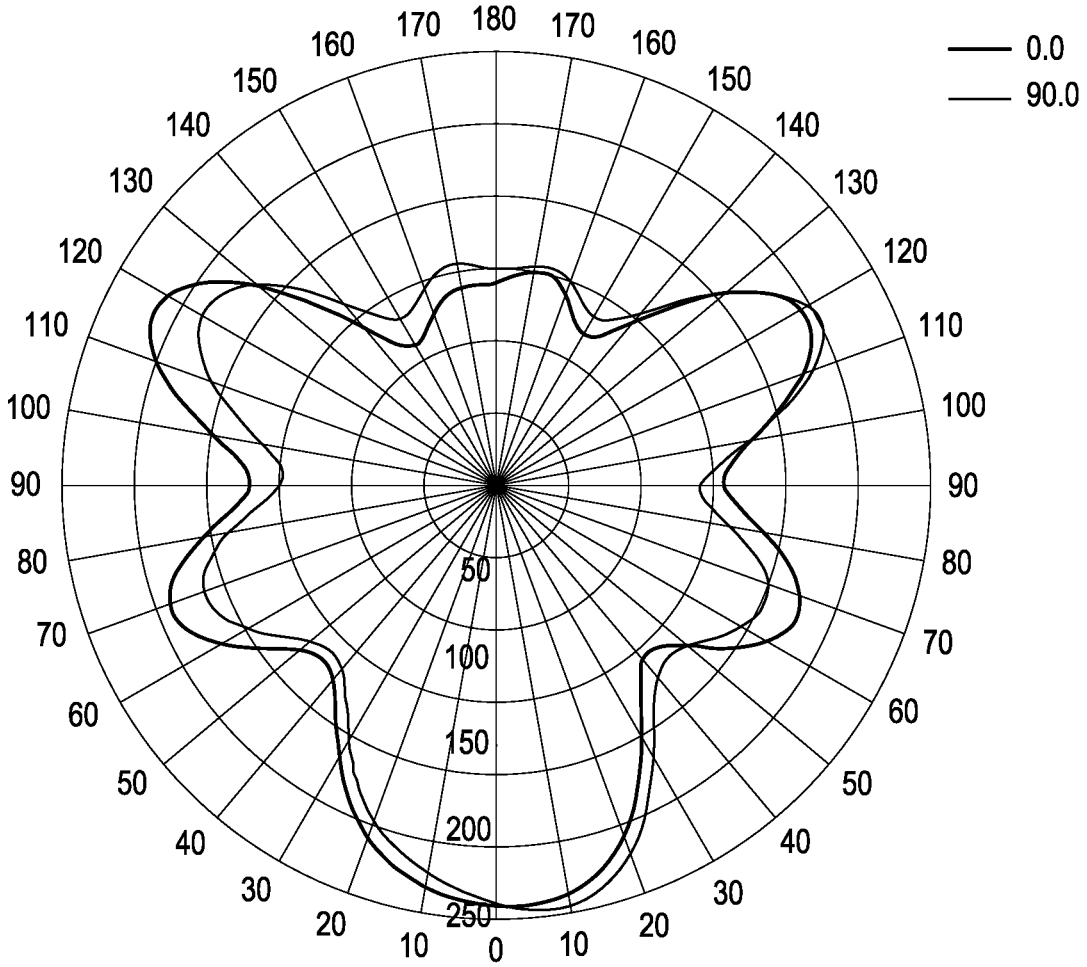
FIG. 19 is a light shape diagram of a wide-angle projection of the lamp in FIG. 16.
Figure 20:
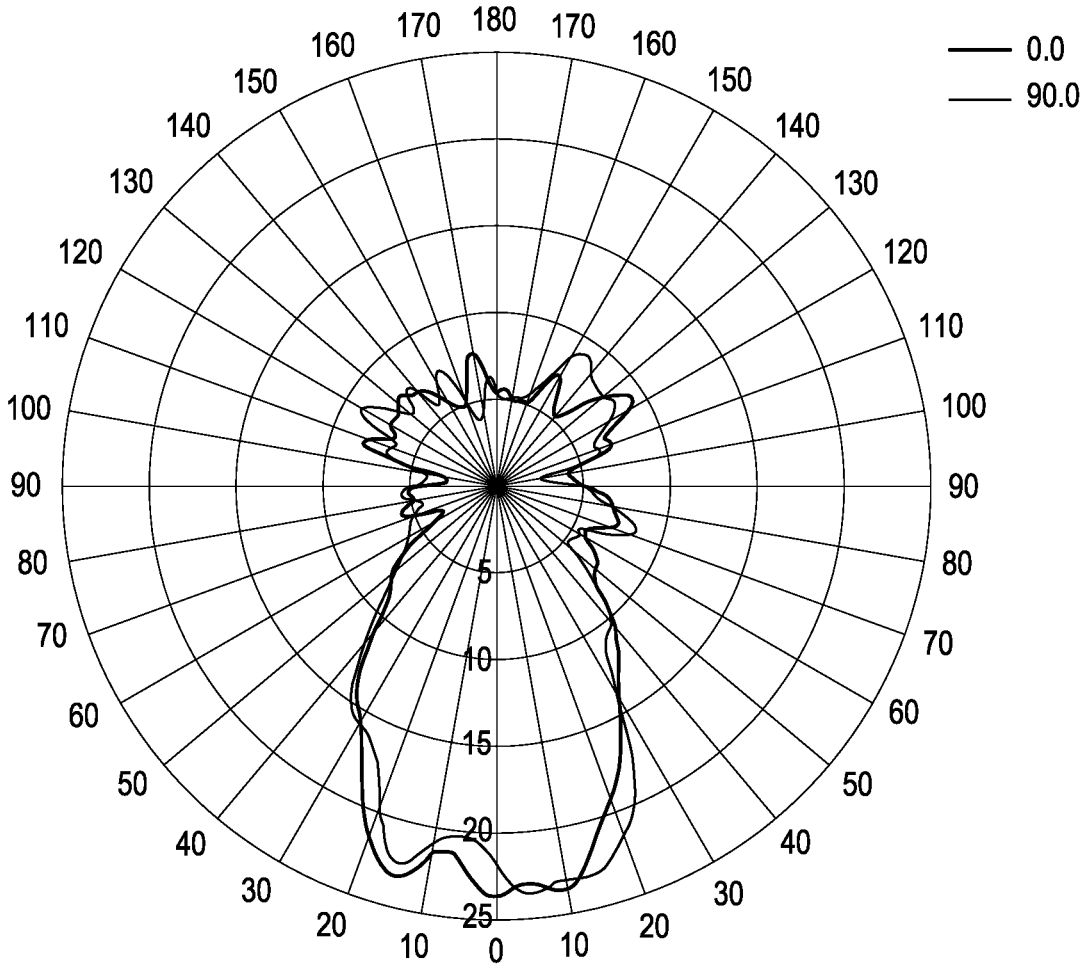
FIG. 20 is a light shape diagram of a narrow angle projection of the lamp in FIG. 16.

With reference to FIGS. 19 and 20, when the distance between the LED 50 and the light incident surface 11 is farther, the adjustable LED lens is at wide-angle projection mode. When the distance between the LED 50 and the light incident surface 11 is shorter, the adjustable LED lens is at narrow angle projection mode. A light distribution angle of the adjustable LED lens at wide-angle projection mode can be bigger than that of the conventional ball bulb. A light distribution angle of the adjustable LED lens at narrow angle projection mode can be smaller than that of the conventional ball bulb. The mode of the adjustable LED lens is changeable as desired.

In conclusion, the light generated by the LED 50 of the adjustable LED lamp passes through the light incident surface 11 and the light-emitting surface 12 of the body 10. The light passing through the adjustable lens is reflected and refracted. By using the concave tapered surface 13 to adjust an angle at which the light goes out and coordinating with the concave cambered surface 16, the flat surface 14, 14*a*, the reflection wing 17, 17*a*, and the reflection surface 18, 18*a* of the light incident surface 11, different light shapes distributions are produced. Therefore, the light distribution angles are increased, the illuminance is enhanced, the illumination range is increased, and a glare is also decreased to fit industry needs. Besides, the distance between the adjustable LED lens and the LED 50 of the holder 40 is changeable to form an appropriate light shape as desired.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable LED lamp comprising:
a holder;
an LED mounted on the holder; and
a lens movably mounted on the holder and having
a body having a light incident surface and a light-emitting surface respectively formed on two opposite sides of the body and the light-emitting surface having a concave tapered surface;
wherein the light incident surface comprises:
a flat surface; and
a convex cambered surface formed on a periphery of the flat surface; and
the body has
a mounting wall surrounding the light incident surface and extending out of the light incident surface;
a mounting part formed on an inner side of the mounting wall; and
a mounting groove formed on an outer side of the holder, corresponding to the mounting part, and having
a longitudinal groove; and
multiple transverse grooves connected with the longitudinal groove;
wherein the mounting part of the lens is put in one of the transverse grooves for adjusting a distance between the LED and the light incident surface.

2. An adjustable LED lamp comprising:
a holder;
an LED mounted on the holder; and
a lens movably mounted on the holder and having
a body having a light incident surface and a light-emitting surface respectively formed on two opposite sides of the body and the light-emitting surface having a concave tapered surface;
wherein the light incident surface comprises:
a flat surface; and a convex cambered surface formed on a periphery of the flat surface; and the body has a mounting wall surrounding the light incident surface and extending out of the light incident surface;

a mounting part formed on an inner side of the mounting wall; and a mounting groove formed on an outer side of the holder, corresponding to the mounting part, and having a longitudinal groove; and multiple transverse grooves connected with the longitudinal groove;

wherein the mounting part of the lens is put in one of the transverse grooves for adjusting a distance between the LED and the light incident surface, wherein the light incident surface comprises:

a flat surface;

a reflection wing formed on an outer edge of the body that abuts the light incident surface, and having a tapered reflection surface abutting the light incident surface; and at least one bent mounting stand mounted on the reflection wing and having a fastening part formed near an end of the mounting stand; and a fastening groove formed on the holder and corresponding to the fastening part.

* * * * *